US012030537B2

(12) United States Patent
Sivalingam et al.

(10) Patent No.: US 12,030,537 B2
(45) Date of Patent: Jul. 9, 2024

(54) METHOD FOR ANALYZING CONDITIONS OF TECHNICAL COMPONENTS

(71) Applicant: SIEMENS MOBILITY GMBH, Munich (DE)

(72) Inventors: Udhayaraj Sivalingam, Unterschleissheim (DE); Michael Taylor, Singapore (SG); Helge Aufderheide, Munich (DE)

(73) Assignee: Siemens Mobility GmbH, Munich (DE)

( * ) Notice: Subject to any disclaimer, the term of this patent is extended or adjusted under 35 U.S.C. 154(b) by 628 days.

(21) Appl. No.: 17/280,339

(22) PCT Filed: Sep. 25, 2019

(86) PCT No.: PCT/EP2019/075875

§ 371 (c)(1),
(2) Date: Mar. 26, 2021

(87) PCT Pub. No.: WO2020/064842

PCT Pub. Date: Apr. 2, 2020

(65) Prior Publication Data

US 2022/0032979 A1 Feb. 3, 2022

(30) Foreign Application Priority Data

Sep. 26, 2018 (EP) ..... 18196838

(51) Int. Cl.
*B61L 15/00* (2006.01)
*B61L 27/57* (2022.01)
*B61L 27/70* (2022.01)

(52) U.S. Cl.
CPC ..... *B61L 15/0081* (2013.01); *B61L 27/57* (2022.01); *B61L 27/70* (2022.01)

(58) Field of Classification Search
CPC .. G06F 11/26; G05B 23/0256; B61L 15/0081
See application file for complete search history.

(56) References Cited

U.S. PATENT DOCUMENTS 5,956,664 A 9/1999 Bryan
2013/0116996 A1* 5/2013 Callan ..... G07C 5/085 703/8

(Continued)

FOREIGN PATENT DOCUMENTS

DE 19858937 A1 6/2000
GB 2416034 A 1/2006

*Primary Examiner* — Jaime Figueroa
*Assistant Examiner* — Jerrod Irvin Davis
(74) *Attorney, Agent, or Firm* — Laurence A. Greenberg; Werner H. Stemer; Ralph E. Locher

(57) ABSTRACT

A method analyzes conditions of technical components in view of a rarity and/or an abnormality of a condition. To provide a reliable analysis and thus a safely operating system the method includes: a) describing conditions of the technical components in a behavioral input space that is spanned by state variables, which are characteristic for the technical components, b) analyzing a condition of one technical component in respect to other conditions of this technical component in the behavioral input space, whereby a rarity of this condition of the technical component is detectable, and c) analyzing the condition of the technical component also in respect to analyses of conditions of further technical components in the behavioral input space. Whereby an abnormality of the condition of the technical component is detectable.

15 Claims, 4 Drawing Sheets

(56) References Cited

U.S. PATENT DOCUMENTS

| | | | | |
|---|---|---|---|---|
| 2018/0208221 | A1* | 7/2018 | Singh | B61L 15/0081 |
| 2021/0276576 | A1* | 9/2021 | Ribbens | B60W 50/14 |
| 2021/0334656 | A1* | 10/2021 | Sjögren | G06N 3/0442 |

* cited by examiner

METHOD FOR ANALYZING CONDITIONS OF TECHNICAL COMPONENTS

BACKGROUND OF THE INVENTION

Field of the Invention

The present invention relates to a method for analysing of conditions of technical components in view of a rarity and/or an abnormality of a condition. The present invention further relates to uses of the analysing method for an observation of a state of a technical component and for a failure prediction of a technical component. Moreover, the present invention further relates to a computer program and to a computer-readable storage medium.

Modern trains operating in modern railway systems are subjected to challenging demands, like travelling with high speed, over long durations and distances as well as having a long service life. Hence, the train and its components need to withstand all kinds of operating conditions, like frequent changes of speed e.g. due to stopping or passing a railway station, train stops at stop signs, speed limits e.g. at bridges or tunnels, (bad) weather and thus temperature changes. Hence, supervising the train and especially important and probably stressed components of the train is essential to ensure a secure operation of the railway system.

This supervision maintenance work may be planned and done more accurately. For example, a target of condition based and predictive maintenance is to exchange or repair components (from single sensors, via modules of a train to a whole vehicle) when (or before) they fail. This requires knowledge at any time about the current state of the component: Is it functioning normally, abnormally, is it in a known failure state? The way to gain this knowledge is by constantly and automatically analysing data produced by the component's sensors, electronics or control system. The typical approach to detect if a component behaves normally is through so-called "Failure mode detection": Take the history of data coming from the component or from identical ones, and check for patterns that have been identified as precursors to specific failure modes. For instance an increase in variance of temperature readings from a bearing sensor may point towards higher fluctuations and a slowly progressing bearing damage. Failure mode detection is a valid approach for components on which a sufficient stock of failure examples exist to actually train an algorithm, or model, that detects these failures. However, in the rail industry, the low number of reproducible failures on trains makes this approach very difficult.

The challenge and opportunity in the rail world is that there are many—often identical—trains that can operate in very different ways over time. It is a challenge because it is not possible to—a priori—know whether a pattern that occurs rarely in the historical data is actually abnormal or simply indicates a rare operational state. At the same time, the similarity of trains is an opportunity because explicit knowledge not only about the characteristics of one historical data stream, but also about which data point originates from which component on which train can be had.

Many approaches and off-the shelf-algorithms exist to identify "abnormal data points" to detect failing components in various industries from wind power to chemistry. However, existing methods are based on using data from a given component to identify abnormal states within that component, such as time series analysis techniques. Or they combine data from the operation of many components while disregarding the actual component identification, making the data usable in standard anomaly detection frameworks, such as for example OneClassSVM, Statistical Outlier Selection; Naïve Bayes statistical models, etc. Finally, there are models that currently allow using categorical values such as component identification, together with sensor data, such as xgboost, or other decision-tree algorithms. These algorithms use the categorical identification as a generic input, i.e. an anomaly detection algorithm of this kind will rather identify a "rare component" than using the meaning of this variable in the overall scoring process.

It is a first objective of the invention to provide a method for analysing of conditions of technical components in view of a rarity and/or an abnormality of a condition with which the above-mentioned challenges and shortcomings can be mitigated, and especially, to provide a method that is more flexible and foresighted as the system known from the prior art as well as a method that provides more safety than known systems.

Further, it is a second object of the invention to provide an advantageous use of the method for an observation of a state of a technical component and especially, to gain reliable knowledge of the state of the technical component for activating possible countermeasures to provide a safe operation of the technical component.

Furthermore, it is a third objective of the present invention to provide a use for the method for a failure prediction of a technical component that allows reliable supervision of the technical component and if needed the initiation of countermeasures for a secure operation of the technical component as well as a train comprising this component.

It is a fourth objective of the present invention to provide an analysing system with which the analysis of the technical component can be advantageously facilitated.

In addition, it is a fifth and sixth objective of the present invention to provide a computer program and a computer-readable storage medium to allow a computer to advantageously carry out the steps of the analysing method.

The first to third objectives may be solved by a method and uses of the method according to the subject-matter of the independent claims.

SUMMARY OF THE INVENTION

Accordingly, the present invention provides a method for analysing of conditions of technical components in view of a rarity and/or an abnormality of a condition.

It is proposed that the method comprises at least the following steps:

A) Describing of conditions of the technical components in a behavioural input space that is spanned by state variables, which are characteristic for the technical components, B) Analysing a condition of one technical component in respect to other conditions of this technical component in said behavioural input space, whereby a rarity of this condition of said technical component is detectable, C) Analysing said condition of said technical component also in respect to analyses of conditions of further (other) technical components in said behavioural input space, whereby an abnormality (specifically a component-abnormality) of said condition of said technical component is detectable.

Due to the inventive method much more accurate and automated assessments on new incoming data whether a component is functioning well or in an abnormal state can be made in comparison with state of the art methods. Moreover, mapping the conditions into the behavioural input space allows for expert-proposed feature-creation, as well as automated feature search. Additionally, aggregation of the mapped data, while retaining explicit information on the originating component or inferring it (component-aware featurization) rather than taking it into account as an additional simple feature can be performed. Further, comparison of the aggregated data through general regions that are characterized not only by the rarity, but which explicitly use the additional component data for assessing the abnormality of a region can be advantageously done. Moreover, automatic cross-correlation and fleet-wide component-aware assessment of the abnormality of new data points can be done.

Further, it can be provided to pre-emptively know when the technical component is starting to fail or may give problems or operates in an unusual—and therefore noteworthy—way. Moreover, maintenance work can be planned in advance and it can be ensured that spare parts are available when needed. Additionally, down time of a system in which the component is employed can be minimized so that costs and time can be saved as well as possible penalties due to a not working or erroneous system can be prevented. Furthermore, the reliability and safety of the component or the system in which the component is employed can be enhanced in comparison with state of the art systems.

In addition, the challenge that there are many identical trains that can operate in very different ways over time can be made more transparent. Hence, it may be possible to asses—a priori—whether a pattern that occurs rarely in the historical data is actually abnormal or simply indicates a rare operational state. At the same time, it is an advantage that explicit knowledge not only about the characteristics of one historical data stream is available, but also about which data point originates from which component on which train.

Thus, instead of simple failure mode detection, the low number of train failures requires a so-called "anomaly detection": First, one uses the history from many different components' data streams to establish the normal behaviour of a component (e.g. the intricate dependencies between pressures, temperatures and passenger numbers that govern a functioning AC system on a train). By training, for example, a model on that data, it learns to classify the commonly occurring patterns in the combined historical data as normal, while it flags any newly incoming data that does not match these patterns or characteristics as abnormal.

Furthermore, since the information which data originates in which components is available, the method provides no simple anomaly detection that is agnostic of this categorical information, but it explicitly includes the component-correlation in the detection of normal and abnormal behaviour. The key here is to establish a model that not only includes the "one-component-pattern" given by the data to determine its abnormality, but also to use the knowledge if this pattern has been observed on other components in the past and may therefore be normal. In simple words, a model is trained that detects not only indicates rare patterns, but rare patterns that occur on few components (component-abnormality).

Establishing a component-aware anomaly model allows to use all historical data to identify normal behaviour, but at the same time allows to distinguish abnormal patterns that are just "rare" but part of normal operation from those that are truly "abnormal". Hence, such a model allows making much more accurate and automated assessments on new incoming data, whether a component is functioning well or in an abnormal state.

Even if a chosen term is used in the singular or in a specific numeral form in the claims and the specification the scope of the patent (application) should not be restricted to the singular or the specific numeral form. It should also lie in the scope of the invention to have more than one or a plurality of the specific structure (s).

In this context a technical component (also referred to as solely "component" in the following text) should be understood as at least one piece or part or as an assembly of functionally related parts. This component may change its state due to different operational modes (expected operations of the component) or over time, due to stress (unexpected or sudden operation/state of the component) or over its normal service live. Hence, the component may have different conditions.

The component may be any component suitable for a person skilled in the art. Preferably, it is a component of a mobile unit. A mobile unit might be any unit, especially constructed unit, like a motor vehicle (car, motor cycle, bicycle, van, lorry, bus, train) that can be moved, especially by human manipulation. Preferably, it may be a track-bound vehicle. A track-bound vehicle is intended to mean any vehicle feasible for a person skilled in the art, which is, due to a physical interaction with a track, especially a predetermined track, restricted to this track or path. A physical interaction/connection should be understood as a form fit connection, an electrical connection or a magnetic connection. The physical connection might be releasable. In this context a "pre-determined track" is intended to mean a beforehand existing, human-built track or path comprising selected means building or forming the track, like a rail or a cable. Preferably, the pre-determined track is a subway track or a railway track, like the UK, German or Russian mainline railway.

The vehicle may be a train, a locomotive, an underground railway, a tram or a trolley bus. Preferably, the track-bound vehicle may be a train or a part thereof, like a locomotive. Advantageously, the track-bound vehicle or the train may be a high speed train. Thus, the method can be used for a network in which a high level of security is essential and needed. The track-bound vehicle may be also referred to as vehicle or train in the following text.

In a preferred refinement of the invention said component and/or the further components is/are a train component and especially, a motor, an air condition, an axle, a wagon, a carriage, a bogie, a wheel, a brake shoe, a brake pad, a spring, a screw, a bearing, a pantograph, a compressor, a transformer or other electrical system, a coolant system, a fan motor, a computing system, a gearbox, a lighting system, a passenger or internal door, a lever, a microphone, an HVAC (Air condition+Heating) or an individual sensor.

The component and a further component or the further components may have any dependency towards each other that may be feasible to a person skilled in the art, like they may be parts of the same assembly or a sub-part of the mobile unit (e.g. wagon or bogie), they may have the same known functional, conditional, operational characteristic(s) (the same material, being exposed to the same conditions, like temperature, pressure, pollution etc.). Preferably, said component and the further components are components of the same type. Hence, parameters, conditions and states of the components can be compared easily.

Further, rarity or a rare condition should be understood as a state of the component that occurs rarely and that may represent a normal or an abnormal condition. A resulting classification as "rare" may solely result from a comparison of the condition of the component with further (historic) conditions of the same component (see step B) of the method) and may be called "component rarity". Or the classification results from an (additional) comparison with conditions of further components as well and may be called "total rarity". For the rarity evaluation the number of occurrences of a condition is determined.

Furthermore, an abnormality or an abnormal condition should be understood as a default, unusual, erroneous condition or as an unusual condition, the origin of which is either an erroneous condition or extremely rare operational state. For the abnormality evaluation a value(s) representing a condition is/are evaluated. Step C) of the method that performs a comparison of the condition with conditions of further components results in a classification of the condition as "component-abnormality", because the component shows abnormal behaviour in comparison with the other components. In contrast, a comparison of the condition of the component with (historical) conditions of the same component may be called solely "abnormality". This evaluation can be done beforehand of the execution of the claimed analysing method.

Moreover, state variables should be understood as characteristic values representing or describing a specific state or condition of the component. These values are preferably measured values or values derived from measures values, in other words, derivatives of measured values. Hence, the state variable of the conditions of the technical components comprises or is derived from or is at least one sensor value. Thus, it is obtained or measured by a sensor.

The sensor may, for example, monitor a mobile unit or a part (the component) thereof. Hence, the sensor may be an on-board or an external (landside) sensor. Moreover, the sensor may be arranged at the mobile unit. The sensor may be a part of an array of sensors, wherein all sensors of the array operate according to the same principle. The sensor may be any sensor feasible for a person skilled in the art, and may be, for example, a sensor selected out of the group consisting of: A radar sensor, an IR-sensor, a UV-sensor, a magnetic sensor, a temperature sensor, a camera and a laser measurement device.

Preferably, the sensor measures at least one parameter, wherein the preferred parameter is dependent on the component under consideration. The parameter may be any parameter feasible for a person skilled in the art and may be, for example, a parameter selected out of the group consisting of: A velocity, an acceleration, a temperature, a pressure, humidity, visibility (e.g. the influence of fog) and a location. Preferably, the parameter may be a pressure or a temperature. For example, a pressure may be detected for a pressurized system (to capture leaking) or a temperature for a system with friction (to capture overheating).

The behavioural input space may be also called conditional input space or the wording may be phrased "Describing of conditions of the technical components in an input space of operation conditions".

In summary to step A): The input data (state variables) is embedded into a suitable input space, in which a position in the input space indicates a combination of sensor values or characteristics for a given component. Doing this for all components individually, obtains a set of multi-variate distributions in this space, one for each component. Multivariate should be understood as a distribution P(X, Y, . . . ) that depends on multiple of the state variables (X, Y, . . . ). For instance: if X=temperature, Y=pressure, Z=speed, then P(X=100° C., Y=4 bar, Z=100 km/h) is the frequency of the combination (100° C., 4 bar, 100 km/h), such that P(X,Y,Z) depends on all three metrics.

In a preferred embodiment of the invention step A) of the method comprises the step of: generating the behavioural input space by using a statistic done on historical data of the behaviour of the technical components. Hence, data used for the input space can be gained conveniently and easily. A useable statistic can be any statistic suitable for a person skilled in the art, like any discrete, e.g. binned, or continuous density function (or probability density function that captures). For instance: Frequency of occurrence of the input state variable combinations, relative time of a given state variable combination being present, mathematically processed derivatives of the above, such as smoothened versions or a distribution corrected for outliers. Also it may be a distribution established by using historical data, but adding domain expert knowledge, such as Kalman-Filtering, Filtering Out of invalid state combinations or the like. Preferably, the statistic results in a density distribution of the data points representing the conditions.

In a further embodiment of the invention step A) of the method may comprise the further steps of: consolidating the statistics for the generating of the behavioural input space of the conditions of the technical components. By this, the statistics can be easily compared. In other words, the conditions are mapped into the input space so that the behaviours are comparable. The consolidating can be done, for example, by transforming the statistics into comparable vectors. For instance, to make the distributions of two components comparable, one may divide the frequency of occurrence of a given state for each component by the sum of all observed occurrences of any state for that component. In simple words, when all conditions are mapped in the same input space, these conditions are comparable, since all conditions are represented by the same characteristic state values.

According to a further aspect of the invention each condition of said technical component and of the further technical components in the behavioural input space is represented by a data point, wherein each data point is characterized by a) its position (=input values/state values or derivatives thereof) and b) a value indicating the originating component and optionally c) the time stamp or interval of measurement. Hence, said component as well as all components can be described precisely and made each component distinguishable from (an) other component(s).

The first step of the normal behaviour finding can be visualized best by considering each input measure (normally a specific sensor value, operational state or derivative of those) as one dimension of the large input space. Hence, each data point in the time-series of these measures is one point in this input space. Combining all data points of all components, a density distribution in the input-space can be obtained, where each data point is characterized by a), b) and preferably as wall by c). Intuitively speaking, the typical behaviour of all components appear as the most densely packed areas of this space, while rare behaviour appears as sparse areas.

According to a further refinement of the invention step A) of the method comprises the further steps of: obtaining the statistic by a method selected out of the group consisting of: rescaling input signals, dimensionality reduction techniques (e.g. PCA) or using derivatives gained by applying other statistical metrics or transformations to the input signals that are suitable for the application. Hence, known and established methods can be employed resulting in reliable results.

Step B) of the method comprises the steps of: determining a distribution of the conditions of said technical component in the behavioural input space for the analysing of the conditions of said technical component, identify characteristic regions in the behavioural input space by using the distribution of said component in the behavioural input space, determining a frequency or at least a number of conditions of said technical component in at least one characteristic region of the behavioural input space. Consequently, each condition of the component can be validated in view of its rarity in comparison with all known other conditions of the same component. Simply speaking, does a characteristic region comprise several conditions, these conditions can be viewed as frequently occurring conditions and hence as normal conditions. However, when the characteristic region comprises few or only one condition, this/these condition(s) may be assessed as rare and potentially as abnormal. These steps may be performed for only one component or for several components individually.

An abnormality can be detected easily if the method comprises in step C) the step of: determining a frequency of conditions of the further technical components in said at least one characteristic region of the behavioural input space for analysing said condition of said technical component also in respect to analyses of conditions of further technical components.

Thus, steps B) and C) of the method can determine for each characteristic region if a component contributes to a characteristic region and/or how many components contribute to a characteristic region and/or which components contribute to the number of conditions in a characteristic region.

In other words, comparable metrics for each characteristic region (cluster) are obtained and for each distribution it is determined how much each component contributes to the data points in that characteristic region by establishing for each characteristic region a vector containing as entries a metric characterizing.

For obtaining the distribution of the conditions in the behavioural input space or for performing the analysis each method or principle feasible for a person skilled in the art may be employed, like an "outlier detection algorithm". Preferably, step C) of the method comprises the steps of: obtaining the distribution of the conditions in the behavioural input space by a method selected out of the group consisting of: a simple density approach, statistical outlier selection, a machine learning based approach, component inference, an AI-based approach (e.g. autoencoder), an approach based on a probability distribution comparison. Due to this, known and established methods can be employed resulting in reliable results.

Further, the determination of the number of contributors for each characteristic region may be done by any method suitable for a person skilled in the art. Such a method or metric should be capable to filter out relevant entries from a comparison of entries of a vector. Advantageously, step C) of the method comprises the steps of: determining the number of contributors for each characteristic region by a method selected out of the group consisting of: counting of non-zero entries, Inverse Participation Ratio (IPR). Thus, convenient methods can be used to gain reliable results.

Based on the multi-component distributions an identification of any new or existing data point as normal or anomalous can be done. More specifically, for a given data point, the position of the data point in the input space can be computed and from this how "abnormal" it is with regard to the distribution of its original component, how "rare" it is with regard to the joint distribution of all other components, but also how "component-wise abnormal" it is with regard to each other component. Hence, abnormality means that the condition represented by the data point is unusual in comparison with historical conditions of said component. Rarity means that the condition of the component is unusual against a general occurrence of such a condition either only in comparison with conditions of the same component (component-rarity) or in comparison with further components (total rarity). Moreover, component-abnormality means that the condition represented by the data point is unusual in comparison with the occurrence of (historical) conditions of further components.

Hence, in case of an evaluation of a condition of a technical component as unclassified in view of rarity and/or abnormality of the condition, the method comprises according to a further aspect of the invention the steps of: identifying a characteristic region of the behavioural input space by checking if the unclassified condition fits into said characteristic region, assuming a rarity of said unclassified condition if a number of classified conditions in the characteristic region is lower than a first predefined threshold (boundary value, limit) of a number of classified conditions contributing to said characteristic region, and assuming an abnormality of said unclassified condition if a number of classified conditions in the characteristic region is lower than a second predefined threshold of a number of classified conditions contributing to said characteristic region, and in case of the assumption of rarity and abnormality classifying the before unclassified condition as rare and abnormal classified condition. Hence, an evaluation of the unknown condition can be done quickly and conveniently. The term "number" should also be understood as a combination of numbers, e.g. ten conditions of at least three components.

Moreover, it might be also possible to use a more dynamic and self-adapting approach. The method would be executed fully as described above.

It is further proposed that the method comprises the step of: assuming a failure of the component in case of a classification of the before unclassified condition as a rare and abnormal classified condition. Thus, a precise evaluation can be done. Consequently, countermeasures can be activated, like changing the erroneous component before severe circumstances, like a total breakdown, may occur. In other words, a failure is assumed in case of: a) the number of components contributing to the characteristically region is low and b) the characteristic (e.g. a value of a state variable) of a component is rare.

In summary, the component-aware anomaly detection can be solved by splitting it into three parts: First, an establishment of statistics on the historical behaviour of each individual component; second, a consolidation of these statistical measures from the individual components into comparable vectors for each of them, and third, an intelligent comparison of the distributions of the conditions of the components to separate their abnormal and normal parts. After that we are ready to classify any data, existing or new as normal or abnormal according to the component-aware anomaly detection algorithm.

The computation of abnormality, rarity and component-abnormality for each data point allows for a detailed assessment of component health: First, the time-development of a combined score of these three indicators (abnormality, rarity and component-abnormality) can be used to identify when a component develops anomalous behaviour with regard to its own components history (e.g. through temporal autocorrelation with past measures).

Second, running a clustering algorithm on the multi-component distribution that splits regions with high component-abnormality score and low rarity (In other words, the condition is a frequent (often) condition, but occurs for view components only. Hence it is a systematic scenario that is usually a normal behaviour.), from regions with high rarity and low component abnormality (In other words, the condition is a rare condition and occurs for a lot of components. Thus, it is a rare operational state and represents no failure. This is in contrast to the case when regions have high rarity and high component abnormality, where the condition is a rare condition and occurs for a view components and thus signals a failure) can automatically distinguish abnormal behaviour of one or multiple components that is due to rare operation or systematic component abnormal behaviour.

Third, rarity and per component abnormality on new data points can be used to classify them as normal or unusual with respect to the fleet other components and the own component allowing to flexibly assess abnormality and therefore risk for a failure.

The invention further refers to a use of the beforehand described analysing method for an observation of a state of a technical component. It is proposed that the use comprises at least the steps of: obtaining different chronological conditions of a technical component by monitoring the state (condition) of the technical component over a period of time, and assigning a rarity and an abnormality for each chronological condition.

Due to the inventive matter it may be determined at which time point a special type of component should be replaced since the risk of a failure of the component increases after this time point. This increases the security of an assembly comprising this component.

The invention further refers to a use of the beforehand described analysing method for a failure prediction of a technical component especially in case of a rare failure event. It is proposed that the use comprises at least the steps of: assuming a failure of the technical component in dependency of a classification of a condition of the technical component as rare and abnormal.

Due to the inventive matter a secure and reliable operation of the component as well as of a system or assembly comprising the component can be provided.

The predicted failure may be any failure feasible for a person skilled in the art, like a falling out, a mismeasurement, a delayed response, a fouling or blocked connection to the component.

The invention and/or the described embodiments thereof may be realised—at least partially or completely—in software and/or in hardware, the latter e.g. by means of a special electrical circuit. Further, the invention and/or the described embodiments thereof may be realised—at least partially or completely—by means of a computer readable medium having a computer program. Thus, the present invention also refers to a computer program comprising instructions which, when the program is executed by a computer, cause the computer to carry out the steps of the analysing method and/or according to the embodiments thereof. Further, the present invention also refers to a computer-readable storage medium comprising instructions which, when executed by a computer, cause the computer to carry out the steps of the analysing method. Additionally, the invention also refers to a computer-readable data carrier having stored thereon the computer program from above.

The present invention also refers to an analysis and/or prediction system comprising, for example, a machine learning system for analysing a rare and abnormal condition of said component and/or for predicting a failure of said component.

It is proposed that the analysis system comprises a receiving device adapted to receive as input data discrete conditional information of the component and an evaluation device adapted to perform the steps of the method and/or for e.g. predicting a failure of the component. In other words, the analysis system is adapted to perform the steps of the analysing method.

The analysis system may comprise a computer and may be located at and/or controlled from a control centre of the network or at the mobile unit itself.

Due to these inventive matters the analysis can be performed automatically and thus saving time and man power.

The previously given description of advantageous embodiments of the invention contains numerous features which are partially combined with one another in the dependent claims. Expediently, these features can also be considered individually and be combined with one another into further suitable combinations. Furthermore, features of the method, formulated as apparatus features, may be considered as features of the assembly and, accordingly, features of the assembly, formulated as process features, may be considered as features of the method.

The above-described characteristics, features and advantages of the invention and the manner in which they are achieved can be understood more clearly in connection with the following description of exemplary embodiments which will be explained with reference to the drawings. The exemplary embodiments are intended to illustrate the invention, but are not supposed to restrict the scope of the invention to combinations of features given therein, neither with regard to functional features. Furthermore, suitable features of each of the exemplary embodiments can also be explicitly considered in isolation, be removed from one of the exemplary embodiments, be introduced into another of the exemplary embodiments and/or be combined with any of the appended claims.

BRIEF DESCRIPTION OF THE SEVERAL VIEWS OF THE DRAWINGS

The present invention will be described with reference to drawings in which.

DETAILED DESCRIPTION OF THE INVENTION

Figure 1:
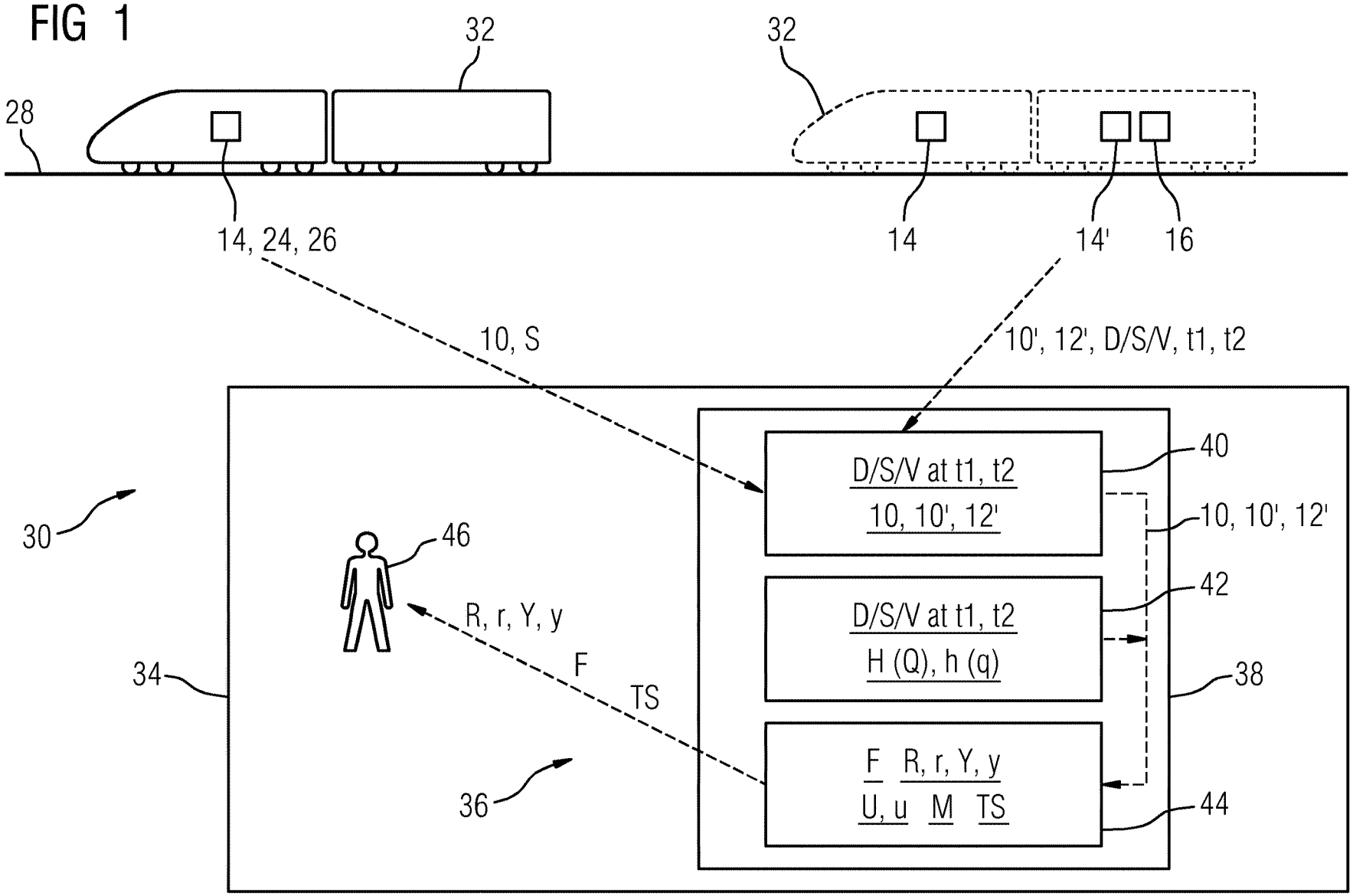
FIG. 1: shows schematically a train with several technical components and an analysis system for analysing of conditions of the components in view of a rarity and/or an abnormality.

FIG. 1 shows in a schematically view a pre-determined track 28 of a railway system 30, like, for example, the German or Russian mainline railway or Munich subway. Moreover, FIG. 1 shows a mobile unit, like a track-bound vehicle, e.g. a train 32 in the form of a high speed train 32, being moveable on the pre-determined track 28.

The railway system 30 further has a control centre 34 that comprises a computer 36 equipped with an appropriate computer program that comprises instructions which, when executed by the computer 36, cause the computer 36 to carry out the steps of an analysis method. Alternatively, the computer 36 may be located on board of the train 32. The proposed method can be used for predicting a failure F of a component 14 or a train component 24, respectively, like a motor 26 of a wagon, of the train 32 (details see below).

Normally, conditions 10 of several components 14, 14', 16 can be analysed simultaneously. In this specification one condition 10 of one component 14 alone will be examined or explained exemplarily as an active component 14 in the analysing process and the failure prediction. The further components 14', 16 will each be viewed as a passive element. However, since normally the condition 10 of several components 14, 14', 16 might be changing the analysis may be done for each component 14, 14', 16 individually.

Moreover, the control centre 34 comprises as part of the computer 36 an analysis system 38 comprising a receiving device 40 to receive as input data sensor values S of the condition 10 of the component 14. Moreover, the analysis system 38 comprises a storage device 42 for storage of parameters, like historic data D (as sensor values S with relating time points t1, t2) or predefined first and second threshold H, h (boundary value or limit) with numbers Q, q of conditions 10', 12' needed to be not exceeded to meet the threshold H, h. Further, the analysis system 38 comprises an evaluating device 44 to process or evaluate the conditions 10, 10', 12' of the components 14, 14', 16 in view of rarity R, r and/or abnormality Y, y of the conditions 10, 10', 12'. The receiving device 40 and the evaluating device 44 are processing devices.

The control centre 34 may be supervised by an operator 46 which may also receive issued outputs, like information concerning rarity R, r or abnormality Y, y or a failure F as result of the failure prediction or a time point (time stamp TS) for a replacement of a component (details see below). The operator 46 may also be a driver of the train 32 or on-board of the train 32.

As stated above, the invention concerns a method for analysing of conditions 10, 10', 12' of technical components 14, 14', 16 in view of a rarity R, r and/or an abnormality Y, y of a condition 10, 10', 12'. Condition 10 is the actual state of the component 14, like the motor 26 of one wagon, of the train 32. Conditions 10' and 12' are historical data D of the component 14 (condition 10') and of the further components 14', 16 (condition 12'). Therefore, the train 32 from which the historical data D were obtained is shown in broken lines. The conditions 10, 10', 12' are represented by state variables V that comprises at least one sensor value S or are sensor values S, like a temperature or a pressure. The component 14 and the further component 14' are components 14, 14' of the same type. In other words, both are motors 26 of different wagons of the train 32. The components 14, 16 may also be of a different kind. However, in that case their state variables V need to have a known correlation towards each other.

In the following description only components 14, 14' and the conditions 10, 10', 12' will be described.

Figure 2:
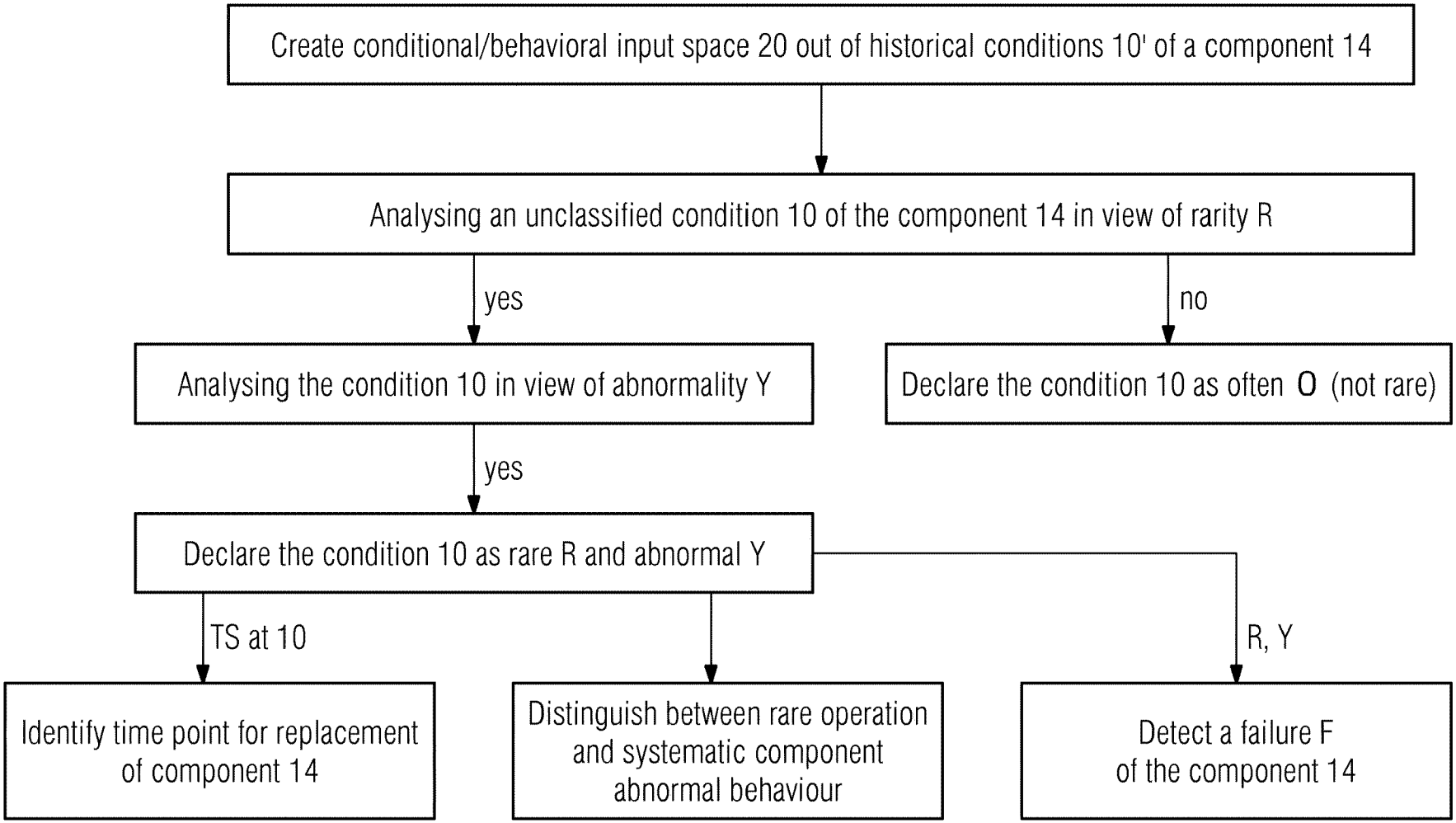
FIG. 2: shows a block-diagram of an operational strategy of the analysis method.

The analysing method will now be described in reference to FIG. 1 and FIG. 2, wherein the latter shows a block-diagram of the operational strategy of the analysing method.

In a first step or in step A of the method the conditions 10, 10', 12' of the technical components 14, 14' are described in a conditional/behavioural input space 20 that is spanned by the state variables V, which are characteristic for the technical components 14, 14'.

The first step of the normal behaviour finding can be visualized best by considering each input measure (normally a specific sensor value, operational state or derivative of those) as one dimension of a large behavioural input space 20. Hence, each data point P in the time-series of these measures is one point in this input space 20. Combining all data points P of all components 14, 14', a density distribution in the input space 20 can be obtained, where each condition 10, 10', 12' of said technical component 14 and of the further technical components 14' in the behavioural input space 20 is represented by a data point P. Each data point P is characterized by a) its position=input values or derivatives and b) a value indicating the originating component 14, 14' and c) the time stamp TS or interval of measurement.

The behavioural input space 20 can be generated by using a statistic done on the historical data D of the behaviour of the technical components 14, 14'. In practice, there are various methods possible to achieve the above embedding of the state variables V or the input values into a suitable behavioural input space 20. Most notably, one can use suitable positions by rescaling input signals, dimensionality reduction techniques (e.g. PCA) or using other derivatives. Also, the embedding does not need to be continuous, but one may also have a categorical axis, such as predictions made by a classifier applied to the original data.

In summary, first the state variables V or the input data are embedded into the suitable input space 20, in which a position indicates a combination of sensor values S or characteristics for a given component 14, 14'. Doing this for all components 14, 14' individually, obtain a set of multivariate distributions in this space 20, one for each component 14, 14'

Figure 3:
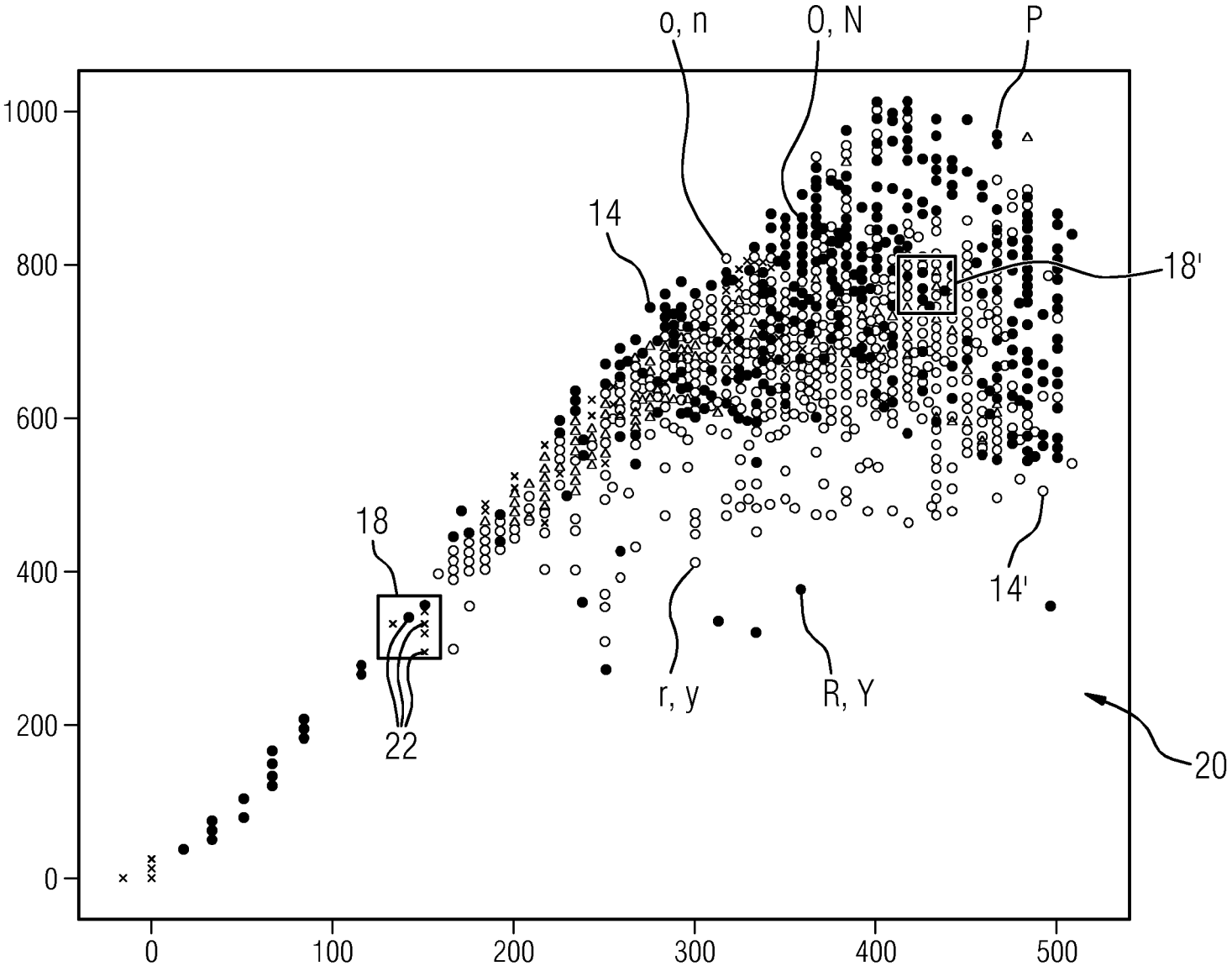
FIG. 3: shows in a diagram the density distributions of four different components

An example for the input space 20 that can be analysed is shown in FIG. 3. More specifically, it shows two input metrics on the X and Y axis, each data point P indicating one observed combination. The symbols (black cycle, open cycle, open triangle, cross) indicate the component 14, 14' assigned to each data point P (indicated with reference numerals for two components 14 (black cycle), 14' (open cycle) only).

When the "input" for four different components 14, 14' is overlaid, it can be observed that the distribution of their data points P is different in some regions and identical in others.

In the second or in step B) of the method a condition 10 of the technical component 14 is analysed in respect to other conditions 10' of this technical component 14 in said behavioural input space 20, whereby a rarity R of this condition 10 of said technical component 14 is detectable.

In this further step the statistics are consolidated. For the analysing of the conditions 10 of said technical component 14 the distribution of the conditions 10, 10' of said technical component 14 in the behavioural input space 20 is determined. In other words, the different component's 14, 14' distributions in the input space 20 are consolidated, so that they can be compared with each other. For the comparison, the raw data points P for different regions 18, 18' of the input space 20 must be aggregated in such a way that comparable metrics for each region 18, 18' and for each distribution will be obtained. More specifically, for each region 18, 18' a vector containing as entries a metric characterizing how much each component 14, 14' contributes to the data points P in that region 18, 18' will be established.

There are various ways to obtain these vectors that indicate component contribution in different regions 18, 18' of the input space 20. They range from simply computing the relative density of data points P from each component 14, 14' in a cube of the input space 20 to using neuronal networks for inferring the probability of a point P in a region 18, 18' origination from a given train 32, using clustering to identify the most significant portions of the input-space 20 or rare events only. These methods for consolidating the raw input data into comparable aggregated distributions for each component 14, 14' are detailed in the following passage.

The target of the three presented methods is to aggregate a set of raw data into an aggregated "region-centered" per-component distribution in the input space 20. In other words, the vector V_regionindex, containing as entries the per-component contributions of the input data in different regions 18, 18' of the input space 20 should be established. The methods are exemplary explained with trains as components 14, 14' and without reference numerals for better readability.

Approach 1—Simple Density

In this approach density measurement technique is used to get a probability mapping region to the set of trains. The method has multiple steps which are described below.

- Initially a scatter plot of sensor signals or values is formed and it is divided into N power (No of senor signals) regions, where N=(1, 2, 3, . . . N). The plot is divided into a suitable number N of individual regions, such as multidimensional cubes that fill in the whole state space. For instance, if two dimensions are used as in the examples, then the input space is divided into rectangles (=cubes of dimension 2).
- Each region in the scatter plot will have samples from different trains. Some regions may be populated with samples from all the trains, some regions from few trains, some from single train and some regions might be empty.
- A multi-label vector Y_regionindex=[y_k], k=(1, 2, 3 . . . M) denotes the train number, M is the no of trains, is assigned to each divided region. y_k denotes the number of points from train k in that particular region. Here the density is calculated with the basic counting technique and it can be replaced with any sophisticated density calculation techniques.
- Possibly multiple smoothing or convolutional filters, interpolation or other splining techniques are applied to obtain a smooth and continuous sensor reading density distribution.
- The multi label vector is normalized to have a unit vector which in turns acts as a probability mapping of the region to the train.
- This normalized vector is passed through the generic mathematical model which is explained before to get the anomalous scores.

Approach: 2 (Machine Learning Based—Component Inference)

In this approach a supervised machine learning technique is used to get a probability mapping of each region in the space of sensor readings to the set of trains. The method has multiple steps which are described below.

- Initially a scatter plot of sensor signals is formed and it is divided into N power (No of senor signals) regions where N=(1, 2, 3, . . . N)
- Each region in the scatter plot will have samples from different trains. Some regions may be populated with samples from all the trains, some regions from few trains, some from single train and some regions might be empty.
- A multi-label vector Y_regionindex=[y_k], k=(1, 2, 3 . . . M) denotes the train number, M is the no of trains, is assigned to each divided region. y_k=1 if the train k have points in the given region and y_k=0 if the train k does not have any points in the given region. i.e., Y_regionindex=[1, 0, 1, 1] in the given example, we see that the given region index is populated with the points from trains 1, 3, 4 but not from 2.
- A supervised machine learning algorithm, in our case convolutional neural network is chosen to learn the mapping from the input regions to the output multi-label array assignment. The input regions and the corresponding multi-label vector act as training samples for our neural network training. The model learns the function F which maps the region to multi-label vector assignment
- Once the model is trained during operation time each region is passed through the model and the multi-label vector is predicted with the model. The predicted vector is normalized to make a probability mapping of the region to the train.
- This predicted vector is passed through the generic mathematical model which is explained before to get the anomalous scores.

Training:

Input sensors→(Regions, multi-label vector)→F→F_learned model

Operation:

Input sensors→(Regions)→F_learned model→multi-label vector→Normalization→multi_lable norm_vector→Mathematical model based Anomaly scorer→Anomalous scores Approach: 3 (Probability Distribution Comparison Based)

In this approach Earth mover's distance (EMD) is used to get a probability mapping of region to the set of trains. The method has multiple steps which are described below.

- Initially a scatter plot of sensor signals is formed and it is divided into N power (No of senor signals) regions where N=(1, 2, 3, . . . N)
- Each region in the scatter plot will have samples from different trains. Some regions may be populated with samples from all the trains, some regions from few trains, some from single train and some regions might be empty. Multidimensional normalized histogram (proxy of probability distribution) for each train in a region is formulated of each of the regions.
- In each region the similarity between one histogram (one train) with the other histogram (other trains) is calculated using Earth Mover's distance. Each train will have a list of similarity scores S_k=(sk1, sk2, . . . skM), where k=(1, 2, 3, . . . M) denotes the train number, where m is the number of trains.
- A multi-label vector Y_regionindex=[y_k], k=(1, 2, 3 . . . M), denotes the train number M is the no of trains, is calculated to each divided region. y_k is the average of all the scores in S_k.
- The multi label vector is normalized to have a unit vector which in turns acts as a probability mapping of the region to the train.
- This normalized vector is passed through the generic mathematical model which is explained before to get the anomalous scores.

Here, the computation of the component-contribution vectors through a simple approach will be exemplarily illustrated. The input space 20 is sliced into cubes of equal size and the density of points P inside each cube is computed for each component 14, 14'. For the example in FIG. 3, the input space is divided into small squares and the number of points P inside each square relative to the total number of points P for the component 14, 14' is computed (not shown). In other words, for each square ("region") a vector with the entries v_i=N_i(region)/N_i(total) is established, wherein i indicates the different components 14, 14'.

Hence, characteristic regions 18, 18' in the behavioural input space 20 are identified by using the distribution of said component 14 in the behavioural input space 20. Then a number U of conditions 10, 10' of said technical component 14 in at least one characteristic region 18, 18' of the behavioural input space 20 is determined.

According to a third step or step C) of the method said condition 10 of said technical component 14 is also analysed in respect to analyses of conditions 12' of further technical components 14' in said behavioural input space 20, whereby an abnormality Y of said condition 10 of said technical component 14 is detectable. Thus, a number u of conditions 12' of the further technical components 14' in said at least one characteristic region 18, 18' of the behavioural input space 20 is determined for analysing said condition 10 of said technical component 14 also in respect to analyses of conditions 12' of further technical components 14'.

Hence, the third step is to identify regions 18, 18' of abnormal behaviour through the vectors v_i. Intuitively speaking, regions 18, 18', where a) the number M of components 14, 14' contributing is low and b) the characteristics of a component 14, 14' is rare should be identified. For this, metrics that identify a) from the vector contributions are required. The simplest metric for this is counting non-zero entries, more advanced metrics are the Inverse Participation Ratio (IPR) (SUM(v_i^4)/SUM(v_i)^2), which i ranges between 1/#Components and 1 depending on the number M of contributing components 14, 14' or contributors 22, 22'. #Components=Number of components, i.e. when having 4 components 14, 14' then the vector has 4 entries and the IPR>1/4. Moreover, "i" runs over the component entries 1 . . . 4.

Figure 4:
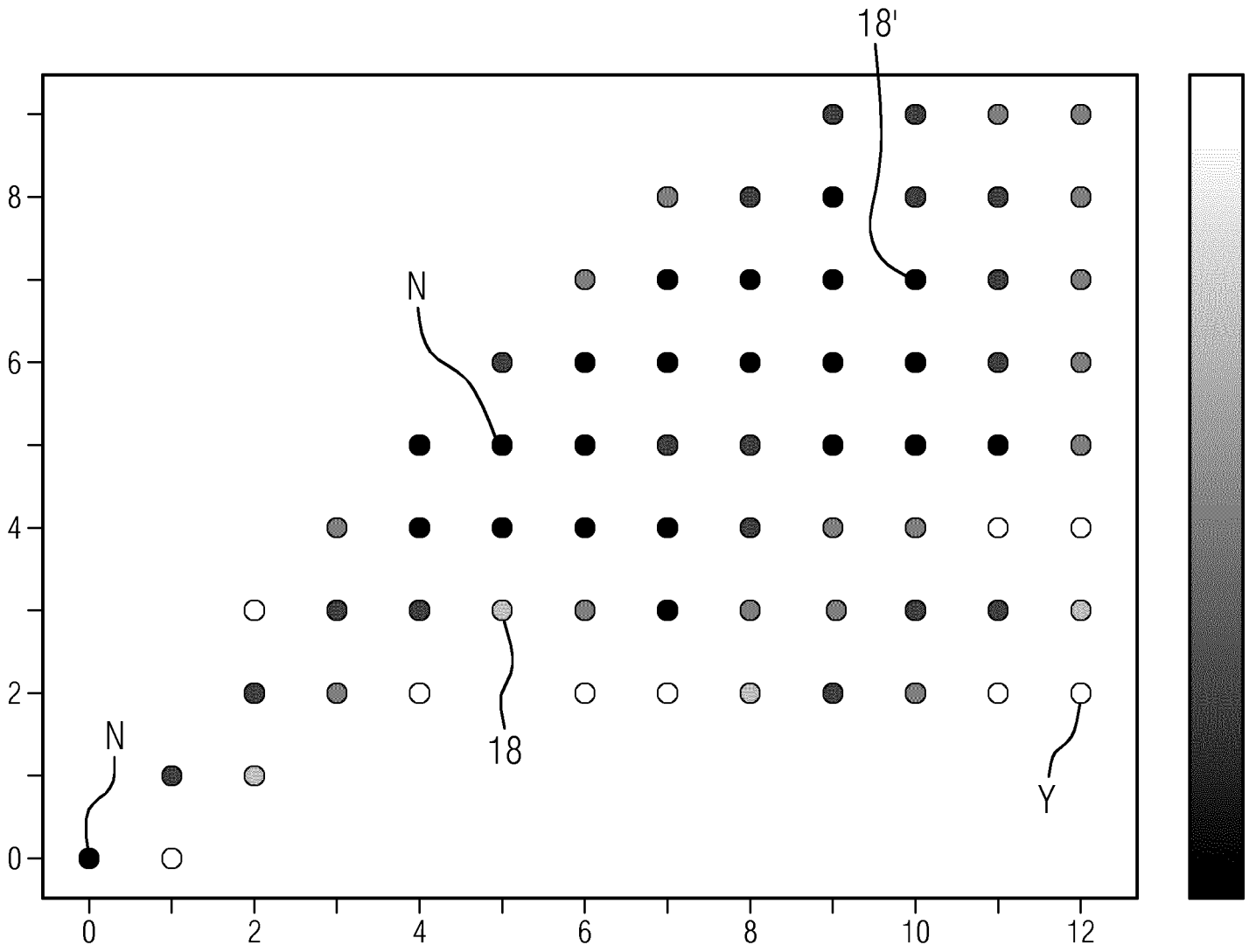
FIG. 4: shows in a diagram the color-coded distribution of the noteworthy-ness of the operation states of one component from FIG. 3.

Indicating the IPR for the above example results in the diagram shown in FIG. 4, which shows the abnormality scores extracted from the density distributions of FIG. 3: The grid placement of the points is due to the square regions that was used to aggregate, each point represents the value of a given region 18, 18'. The "degree of grey" indicates how "abnormal" that given regions 18, 18' is according to the IPR, black indicates abnormal and white normal regions.

Using a component-aware distribution gives a much more detailed picture of normal and anomalous behaviour. For instance, the region of (0, 0) is flagged as normal N despite a very low number of data points P, because almost all components 14, 14' show this behaviour sometimes. At the same time, the data point P at the right bottom is flagged as unusual or abnormal Y, because data points P in this region 18, 18' are only exhibited by few components 14, 14'. While the black region in the middle would have been identified as normal N by any standard approach, this level of detail makes it possible to more granularly distinguish rare from abnormal behaviour.

Based on the multi-component distributions, now any new or existing data points P as normal N or anomalous Y can be identified. More specifically, for a given data point P, the position of the data point P in the input space 20 can be computed and from this how "abnormal" it is with regard to the distribution of its original component 14, how "rare" it is with regard to the joint distribution of all other components 14', but also how "component-wise abnormal" it is with regard to each other component 14'. As shown in FIG. 3 data points P or conditions 10, 10', 12' clustered in the densely middle region 18' will be assessed as often O (not-rare) and normal N (not abnormal) for the conditions 10, 10' of the component 14 (black cycle) and as often o and normal n for the condition 12' of the further component 14' (open cycle). However, data points P or conditions 10, 10', 12' in a less populated region 18 (not marked by a square and with a reference number 18) will be assessed as rare R and abnormal Y for the conditions 10, 10' of the component 14 (black cycle) and as rare r and abnormal y for the condition 12' of the further component 14' (open cycle)

Hence, in case of an evaluation of a condition 10 of a technical component 14 as unclassified in view of a rarity R and/or an abnormality Y of the condition 10, the method comprises the steps of: identifying a characteristic region 18, 18' of the behavioural input space 20 by checking by the evaluation device 44 if the unclassified condition 10 fits into said characteristic region 18, 18', assuming a rarity R of said unclassified condition 10 if a number U of classified conditions 10' in the characteristic region 18, 18' is lower than the first predefined threshold H of the number Q of classified conditions 10', 12' contributing to said characteristic region 18, 18', and assuming an abnormality Y of said unclassified condition 10 if a number U, u (also the sum of the numbers U and u) of classified conditions 10', 12' in the characteristic region 18, 18' is lower than the second predefined threshold h of the number q of classified conditions 10', 12' contributing to said characteristic region 18, 18', and in case of the assumption of rarity R and abnormality Y classifying the before unclassified condition 10 as rare and abnormal classified condition 10.

For example, the first boundary value/threshold H is a number Q of a maximum of three conditions 10' of component 14 and the second boundary value/threshold h is a number q of a maximum of ten conditions 10' 12' of at least three different components 14, 14'. It was identified that the unclassified condition 10 fits into region 18 (not shown in detail). In this region 18 the number U of conditions 10' of component 14 contributing to this region 18 is two and the number U, u of conditions 10', 12' of components 14, 14' contributing to this region 18 is nine conditions 10', 12' of four components 14, 14' (the number U of two conditions 10' of component 14, as numbers u the sum of three conditions 12' of a first further component 14' and two times two conditions 12' of a second and third further components 14'). The value two is fitting the criteria of the number Q of the first boundary value H of "a maximum of three conditions 10'". Further, the value nine is fitting the criteria of the number q of the second boundary value h of "a maximum of ten conditions 10' 12' of at least three different components 14, 14'". Hence, the unclassified condition 10 would be assessed as being rare R and abnormal Y.

Moreover, in a further step of the inventive method a failure F of the component 10 is assumed in case of a classification of the before unclassified condition 10 as a rare and abnormal classified condition 10.

The computation of abnormality Y, rarity R and component-abnormality for each data point P allows for a detailed assessment of component health: First, we can use the time-development of a combined score of these three indicators to identify when a component 14 develops anomalous behaviour with regard to its own components history (e.g. through temporal autocorrelation with past measures). Second, running a clustering algorithm on the multi-component distribution that splits regions 18, 18' with high component-abnormality score and low rarity, from regions 18, 18' with high rarity and low component abnormality can automatically distinguish abnormal behaviour of one or multiple components 14 that is due to rare operation or systematic component abnormal behaviour. Hence, this detection of true abnormalities allows distinguishing if the component is needed to be maintained or not. Third, rarity and per component abnormality can be used on new data points P to classify them as normal or unusual/abnormal Y with respect to the fleet other components 14', 16 and the own component 14 allowing to flexibly assess abnormality and therefore risk for failure F.

Hence, the method can be used for an observation of a state of the technical component 14, wherein the use comprises the steps of: obtaining different chronological conditions 10, 10' of the technical component 14 by monitoring the state of the technical component 14 over a period of time t1, t2, and assigning rarity R and abnormality Y for each chronological condition 10, 10'. Through this a time point may be selected to indicate when this type of component 14 needs to be replaced. This time point is represented by the time stamp TS of condition 10.

Moreover, the method can be used for a failure prediction of the technical component 14, wherein the use comprises the step of: assuming a failure F of the technical component 14 in dependency of a classification of a condition 10 of the technical component 14 as rare R and abnormal Y.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

Although the invention is illustrated and described in detail by the preferred embodiments, the invention is not limited by the examples disclosed, and other variations can be derived therefrom by a person skilled in the art without departing from the scope of the invention.

The invention claimed is:

1. A method for analyzing conditions of technical components of a track bound vehicle in view of a rarity and/or an abnormality of a condition, the method comprises the following steps of:

a) describing the conditions of the technical components in a behavioral input space being spanned by state variables, which are characteristic for the technical components;

b) analyzing the condition of a technical component of the technical components in respect to other conditions of the technical component in the behavioral input space, whereby the rarity of the condition of the technical component is detectable, wherein step b) comprises the sub-steps of:

determining a distribution of the conditions of the technical component in the behavioral input space for the analyzing of the conditions of the technical component;

identify characteristic regions in the behavioral input space by using a distribution of the technical component in the behavioral input space; and determining a number of the conditions of the technical component in at least one characteristic region of the behavioral input space;

c) analyzing the condition of the technical component also in respect to analyses of conditions of further technical components in the behavioral input space, whereby the abnormality of the condition of the technical component is detectable, wherein step c) comprises the sub-steps of:

determining a number of the conditions of the further technical components in the at least one characteristic region of the behavioral input space for analyzing the condition of the technical component also in respect to analyses of the conditions of the further technical components; and initiating counter measures for secure operation of the technical component upon detecting the technical component as a failing technical component and/or ordering a new technical component for replacing the technical component.

2. The method according to claim 1, wherein step a) of the method comprises the sub-step of generating the behavioral input space by using a statistic done on historical data of a behavior of the technical components.

3. The method according to claim 2, wherein step a) of the method comprises the sub-step of consolidating statistics for the generating of the behavioral input space of the conditions of the technical components.

4. The method according to claim 2, wherein step a) of the method comprises the sub-step of obtaining the statistic by a method selected from the group consisting of: rescaling input signals, dimensionality reduction techniques and using derivatives gained by applying statistical metrics or transformations to input signals.

5. The method according to claim 1, wherein each said condition of the technical component and of the further technical components in the behavioral input space is represented by a data point, wherein each said data point is characterized by a) its position, and b) a value indicating an originating component.

6. The method according to claim 5, wherein each said data point is characterized by c) a time stamp or an interval of measurement.

7. The method according to claim 1, wherein step c) of the method comprises the sub-step of obtaining the distribution of the conditions in the behavioral input space by a method selected from the group consisting of: a simple density approach, statistical outlier selection, a machine learning based approach, component inference, an AI-based approach, and an approach based on a probability distribution comparison.

8. A method for analyzing conditions of technical components of a track bound vehicle in view of a rarity and/or an abnormality of a condition, the method comprises the following steps of:

a) describing the conditions of the technical components in a behavioral input space being spanned by state variables, which are characteristic for the technical components;

b) analyzing the condition of a technical component of the technical components in respect to other conditions of the technical component in the behavioral input space, whereby the rarity of the condition of the technical component is detectable, wherein step b) comprises the sub-steps of:

determining a distribution of the conditions of the technical component in the behavioral input space for the analyzing of the conditions of the technical component;

identify characteristic regions in the behavioral input space by using a distribution of the technical component in the behavioral input space; and determining a number of the conditions of the technical component in at least one characteristic region of the behavioral input space;

c) analyzing the condition of the technical component also in respect to analyses of conditions of further technical components in the behavioral input space, whereby the abnormality of the condition of the technical component is detectable, wherein step c) of the method comprises the sub-steps of:

determining a number of contributors for each characteristic region by a method selected from the group consisting of: counting of non-zero entries and Inverse Participation Ratio; and initiating counter measures for secure operation of the technical component upon detecting the technical component as a failing technical component and/or ordering a new technical component for replacing the technical component.

9. The method according to claim 1, wherein the state variable of the conditions of the technical components includes at least one sensor value.

10. The method according to claim 1, wherein the technical component and the further technical components are components of a same type and/or the technical further components are train components.

11. The method according to claim 10, which further comprises selecting the train component from the group consisting of a motor, an air condition, an axle, a wagon, a carriage, a bogie, a wheel, a brake shoe, a brake pad, a spring, a screw, a bearing, a pantograph, a compressor, a transformer, other electrical systems, a coolant system, a fan motor, a computing system, a gearbox, a lighting system, a passenger door, an internal door, a lever, a microphone, an HVAC and an individual sensor.

12. The method according to claim 1, wherein for observation of a state of the technical component, the method further comprises the following steps of:

d) obtaining different chronological conditions of the technical component by monitoring a state of the technical component over a period of time; and e) assigning the rarity and the abnormality for each chronological condition.

13. The method according to claim 1, wherein for failure prediction of the technical component, the method further comprises the following step of:

d) assuming a failure of the technical component in dependency of a classification of the condition of the technical component as rare and abnormal.

14. A method for analyzing conditions of technical components of a track bound vehicle in view of a rarity and/or an abnormality of a condition, the method comprises the following steps of:

a) describing the conditions of the technical components in a behavioral input space being spanned by state variables, which are characteristic for the technical components;

b) analyzing the condition of a technical component of the technical components in respect to other conditions of the technical component in the behavioral input space, whereby the rarity of the condition of the technical component is detectable, wherein step b) comprises the sub-steps of:

determining a distribution of the conditions of the technical component in the behavioral input space for the analyzing of the conditions of the technical component;

identify characteristic regions in the behavioral input space by using a distribution of the technical component in the behavioral input space; and determining a number of the conditions of the technical component in at least one characteristic region of the behavioral input space;

c) analyzing the condition of the technical component also in respect to analyses of conditions of further technical components in the behavioral input space, whereby the abnormality of the condition of the technical component is detectable;

wherein in case of an evaluation of the condition of the technical component as unclassified in view of the rarity and/or the abnormality of the condition, the method further comprises the steps of:

identifying the at least one characteristic region of the behavioral input space by checking if the unclassified condition fits into the at least one characteristic region;

assuming the rarity of the unclassified condition if a number of classified conditions in the at least one characteristic region is lower than a first predefined threshold of a number of classified conditions contributing to the at least one characteristic region;

assuming the abnormality of the unclassified condition if a number of the classified conditions in the at least one characteristic region is lower than a second predefined threshold of a number of the classified conditions contributing to the at least one characteristic region; and classifying a before unclassified condition as a rare and abnormal classified condition in case of an assumption of the rarity and the abnormality; and initiating counter measures for secure operation of the technical component upon detecting the technical component as a failing technical component and/or ordering a new technical component for replacing the technical component.

15. The method according to claim 14, which further comprises the step of assuming a failure of the component in case of a classification of the before unclassified condition as the rare and abnormal classified condition.

* * * * *